US005244038A

United States Patent [19]

Watkins

[11] Patent Number: 5,244,038

[45] Date of Patent: Sep. 14, 1993

[54] WELLHEAD EQUIPMENT

[75] Inventor: Bruce J. Watkins, Houston, Tex.

[73] Assignee: Dril-Quip, Inc., Houston, Tex.

[21] Appl. No.: 932,621

[22] Filed: Aug. 17, 1992

[51] Int. Cl.[5] ..... E21B 33/00

[52] U.S. Cl. ..... 166/85; 166/120

[58] Field of Search ..... 166/85, 86, 377-382, 166/120, 183, 184

[56] References Cited

U.S. PATENT DOCUMENTS 3,468,559 9/1969 Ahlstone .
3,924,678 12/1975 Ahlstone .
4,067,062 1/1978 Baugh .
4,386,656 1/1983 Fisher et al. .
4,391,325 7/1983 Baker et al. .
4,712,621 12/1987 Wightman ..... 166/382
4,757,860 7/1988 Reimert .
4,807,705 2/1989 Henderson et al. ..... 166/85 X
4,880,061 11/1989 Ahlstone .
4,969,519 11/1990 Kelly .
5,044,433 9/1991 Rubbo et al. ..... 166/120
5,048,606 9/1991 Allwin .
5,095,978 3/1992 Rubbo et al. ..... 166/120

*Primary Examiner*—Thuy M. Bui
*Attorney, Agent, or Firm*—Vaden, Eickenroht, Thompson, Boulware & Feather

[57] ABSTRACT

There is disclosed wellhead equipment wherein a tubing hanger suspended from a running tool lowered with the running tool into a landed position within a bore of a casing head, and a seal assembly suspended from the running tool is, upon landing of the hanger, lowered into an annular space between the tubing hanger and bore so as to seal with respect to them and thereby close the space.

6 Claims, 5 Drawing Sheets

WELLHEAD EQUIPMENT

Figure 1A:
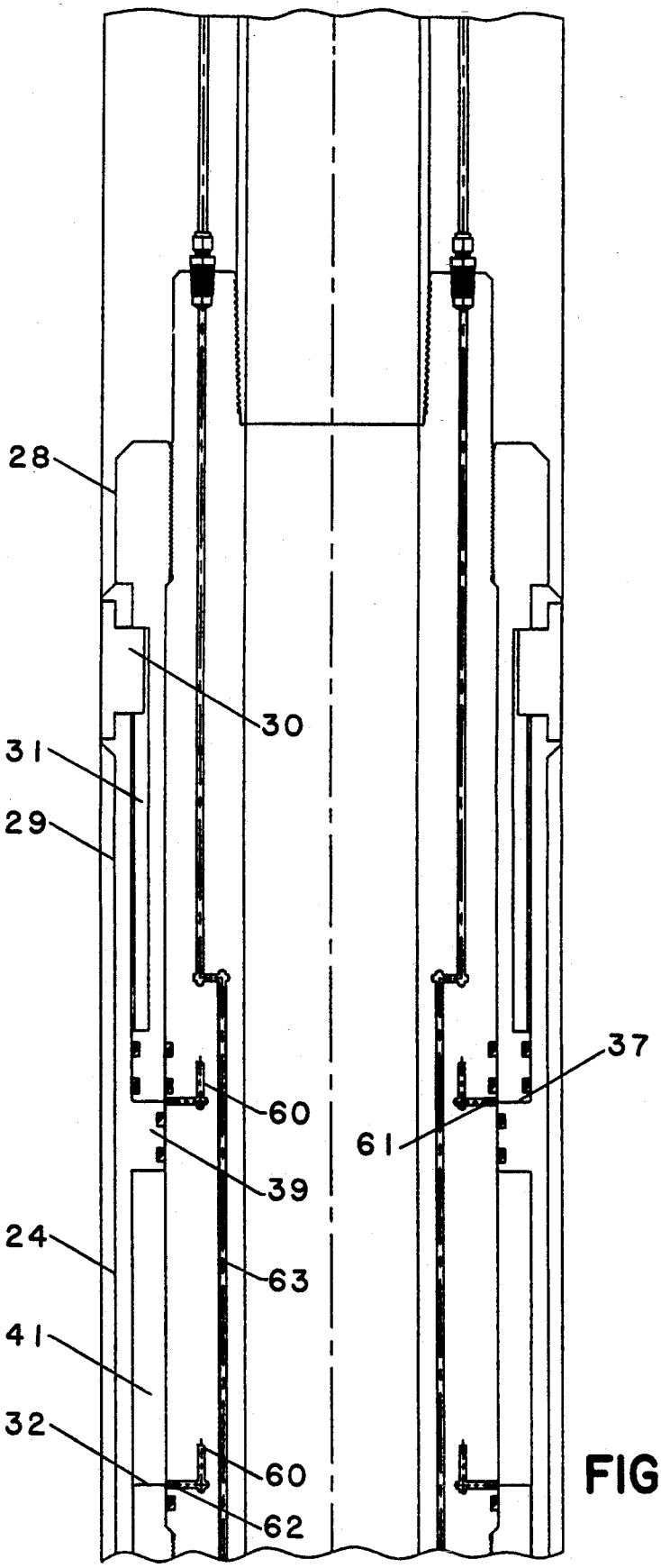

This invention relates to wellhead equipment of the type in which a plurality of hangers are landed successively within a casing head installed at the upper end of an outer casing string within a well bore for the purpose of suspending well pipe strings therein one within another, and seal assemblies are installed in sealing engagement with each hanger and the bore in order to close off annular spaces between them, each hanger and its associated seal assembly being so installed by means of a running tool suspended from a pipe string for lowering therewith which, upon installation of the hanger and seal assembly, is released from them to permit it to be retrieved. Conventionally, such equipment includes one or more casing hangers for suspending inner casing strings and a tubing hanger for suspending a tubing string within the innermost casing string, and this invention relates more particularly to improvements in the tubing hanger and its associated seal assembly and a running tool for installing them.

U.S. Pat. No. 4,800,061 shows equipment of this general type in which a tubing hanger and its associated seal assembly are installed by means of a running tool including a first tubular member suspended from the pipe string and connected to the hanger for lowering therewith and a second tubular member to which the seal assembly is connected for vertical reciprocation with respect to the first member to lower the seal assembly from a raised position above the annular space between the hanger and bore and a lower position within the annular space to seal off between the hanger and bore. Then, upon locking the seal assembly in its lower position, the second member of the running tool may be released from it and the first member disconnected from the hanger, to permit the running tool to be raised therefrom for retrieval with the first member. More particularly, the second member is so reciprocated by the supply of a remote source of pressure fluid to and exhaust of pressure fluid from chambers formed between the members.

There are occasions in which it is desirable, upon landing of the tubing hanger, to perform certain operations in the well bore. Thus, for example, it may be desirable to set a packer suspended from the tubing string, which, like many other downhole tools, requires right-hand rotation. At the same time, however, since the joints of the well pipe string from which the running tool is suspended are made up with right-hand rotation, it is conventional practice to connect the running tool to the hanger by left-hand threads in order to avoid disconnecting the joints of the pipe string as the running tool is disconnected from the hanger to permit it to be retrieved upon setting of the seal assembly. Thus, with conventional wellhead equipment, such as that disclosed in the aforementioned patent, it is impossible or at least impractical to set such downhole tools, and it is the primary object of this invention to provide such equipment in which right-hand rotation may be imparted to the tubing string for these and other operations.

In the installation of equipment of this type, difficulty may be encountered in latching the seal assembly within the space between the hanger and bore of the head in such a manner to insure that it maintains a seal with respect to both of them. Thus, for example, if the seal assembly is allowed to back off from its set position, it may permit well fluids from below to leak past it. Also, there are occasions in which it is desirable to transmit fluid into the well bore beneath the hanger upon landing of the hanger, but prior to setting of removal of the running tool, as, for example, to activate tools in the well bore.

It is a further object of this invention to provide equipment of the type in which the seal assembly is latched in its lowered position in such a manner as to maintain a seal with respect to both the hanger and bore of the casing head.

Still another object is to provide such equipment which enables fluid under pressure to be transmitted to the well bore beneath the hanger when the hanger is landed but prior to retrieval of the running tool.

These and other objects are accomplished in accordance with the illustrated embodiment of the present invention, by wellhead equipment of the type described having a tubular body adapted to be connected to the tubing hanger by right-hand threads, a running tool which includes a first tubular member connectable to a pipe string for lowering therewith and connectable to the tubular body by left-hand threads for lowering the tubing hanger into its landed position, and a second tubular member rotatable with but vertically reciprocable with respect to the first member, and a seal assembly releasably connected to the second tubular member. More particularly, the members have means which form pressure chambers between them and a means is provided for supplying pressure fluid to and exhausting pressure fluid from the chambers to raise or lower the second member and thus the seal assembly with respect to the first, whereby, upon landing of the hanger, the seal assembly may be lowered into sealing engagement with the hanger and bore of the head to close off the annular space between them and then latched in its lowered position within the annular space. More particularly, means are provided for locking the second member to the body to prevent rotation therebetween when the second member is in a raised position, whereby the pipe string may be rotated to the right so as to impart right-hand rotation to the tubing string, but being releasable when said seal assembly has been lowered with the second member into said space and the first member has been rotated to the right to release it from threaded connection to said tubular body to permit the running tool to be retrieved.

As will be understood, this then permits right-hand rotation to be imparted to the hanger through the tubular body in order to set a packer or other tools suspended from the tubing string, without the risk of disconnecting a joint in the pipe string. Then, of course, the tubular body may be disconnected from the tubing hanger in order to permit other parts to be connected to the hanger during the well completion process. Thus, the tubing hanger has a neck with an outer seal surface thereabout, and the tubular body has a lower extension disposable over the seal surface when connected to the hanger such that the tubular body also serves as a protector for the seal surface prior to its removal.

The seal assembly is adapted to be latched to the hanger by means which comprises a recess about the hanger, and a split ring carried by the seal assembly for radial movement into the recess as the seal assembly is lowered into sealing position. More particularly, the split ring has right-hand threads for ratcheting over matching threads in the recess as it moves into the recess, and the second member is releasably connected to the split ring by a pin and J-slot, whereby the split ring may be lowered in response to right-hand rotation of the running tool and the running tool released from the seal assembly for raising therefrom in response to left-hand rotation thereof.

In accordance with another novel aspect of the invention, a first passageway in the first member is connectable at one end to the lower end of a conduit extending within the bore of the casing head, a second passageway in the tubular body is connectable at one end to the upper end of a conduit extending downwardly into the annulus and at the opposite end with the opposite end of the first passageway, and means are provided for sealing between the tubular body and first tubular member above and below the connection of the opposite ends of the passageways, whereby fluid may be transmitted from the surface to the well bore beneath the hanger prior to retrieval of the running tool.

In the preferred embodiment of the invention, the locking means comprises a vertical slot in the outer side of the tubular body, a lug carried within a hole in the first tubular member and surrounded by the seal assembly to hold its inner end in the slot when the seal assembly is in raised position. More particularly, a split ring surrounds the lug to yieldably hold it in the slot, and lug and slot are so configured as to permit the lug to be moved with the first tubular member out of the slot in response to rotation of the running tool to release it from connection to the seal assembly following lowering of the seal assembly.

Figure 1B:
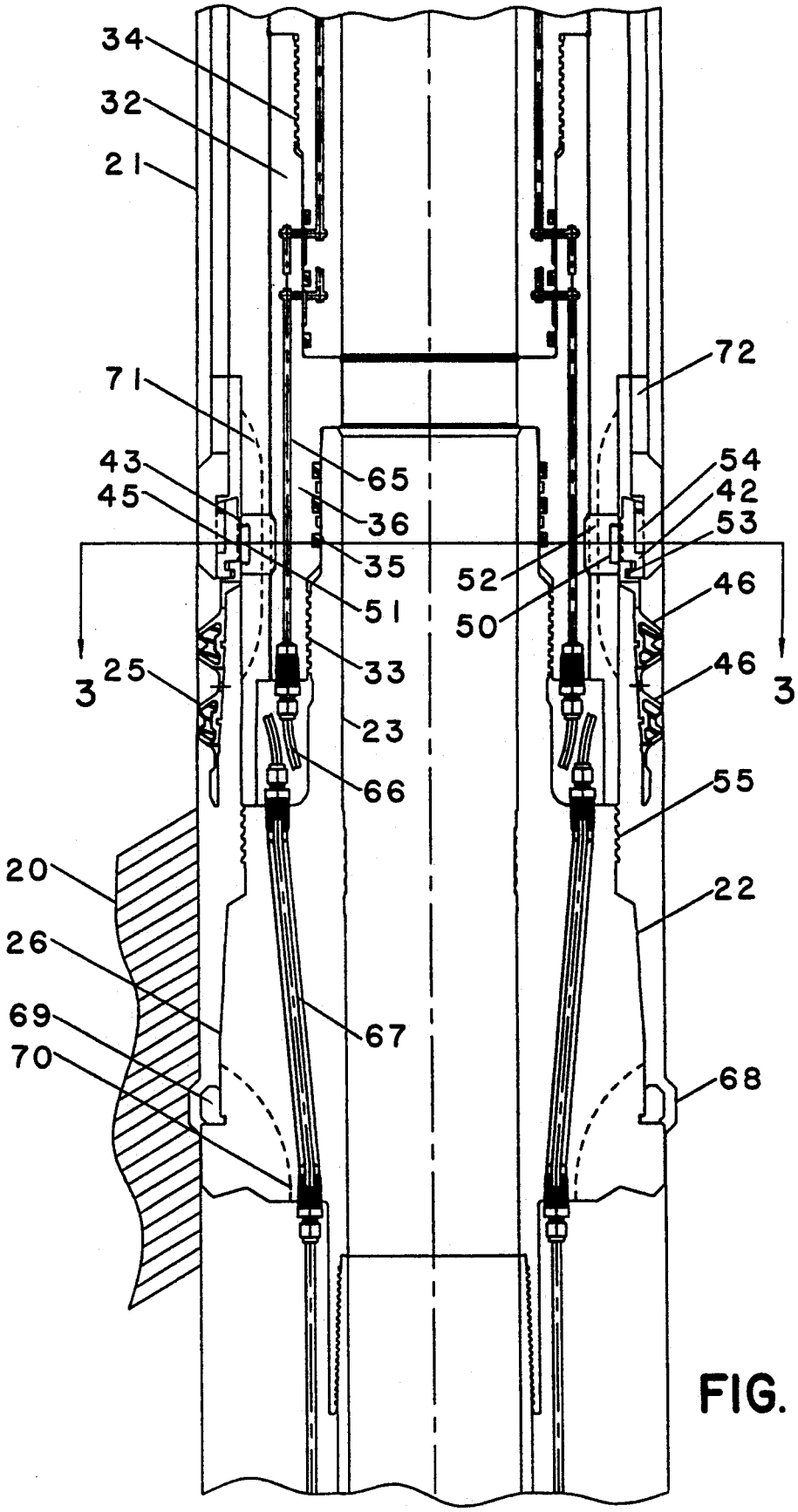
Figure 2A:
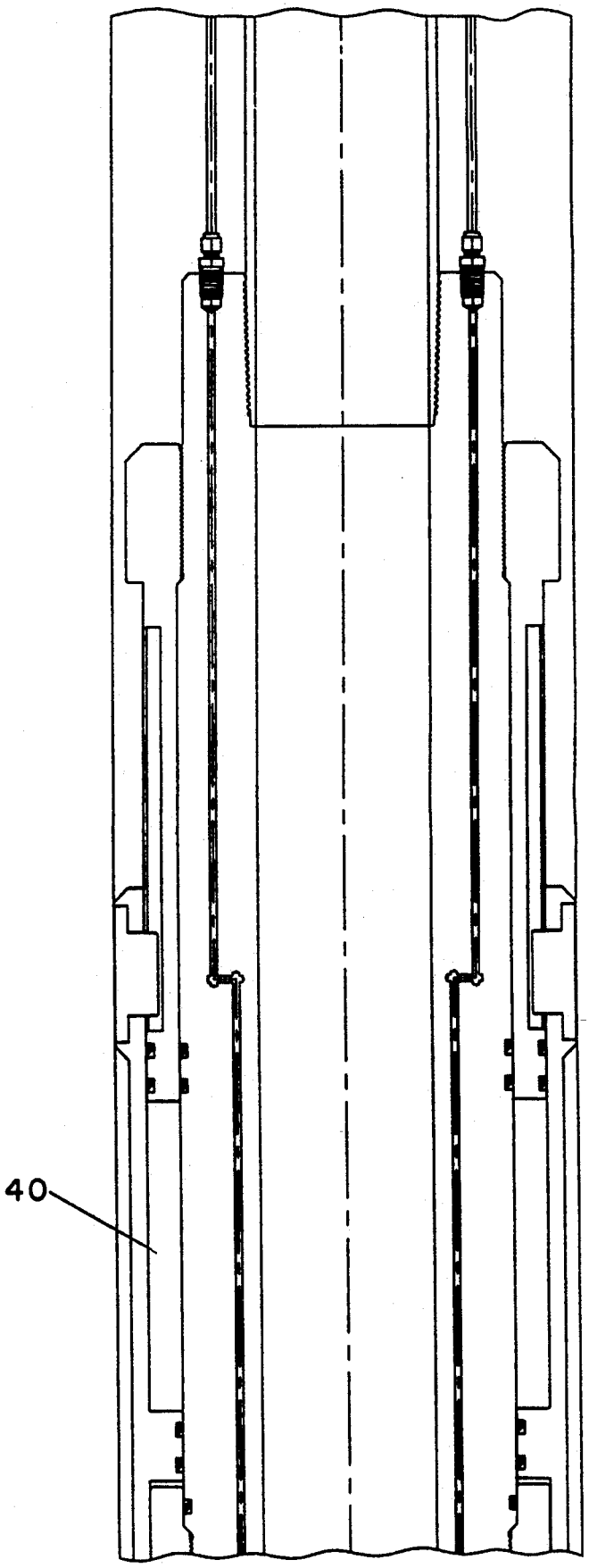
Figure 2B:
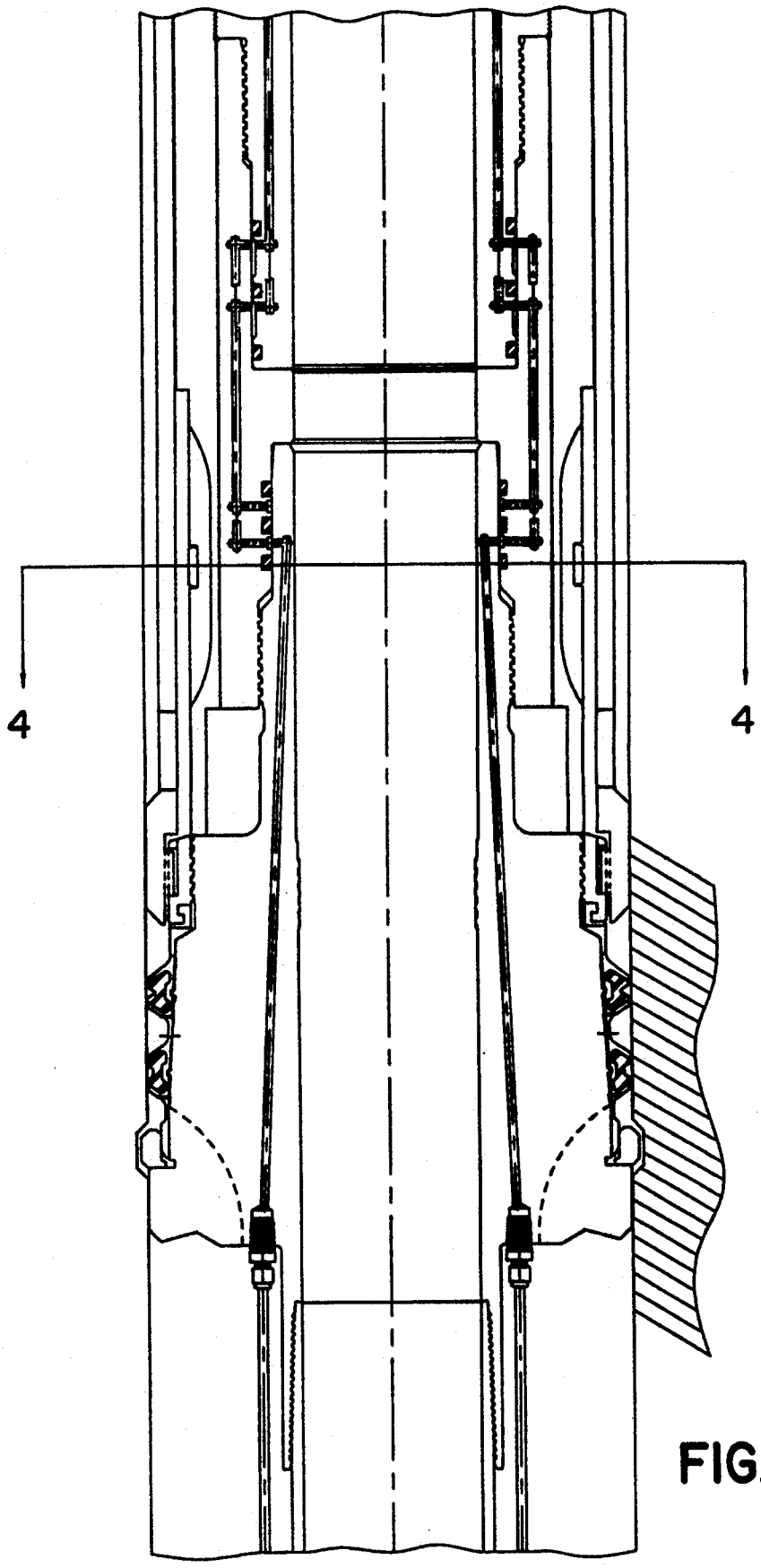
Figure 3:
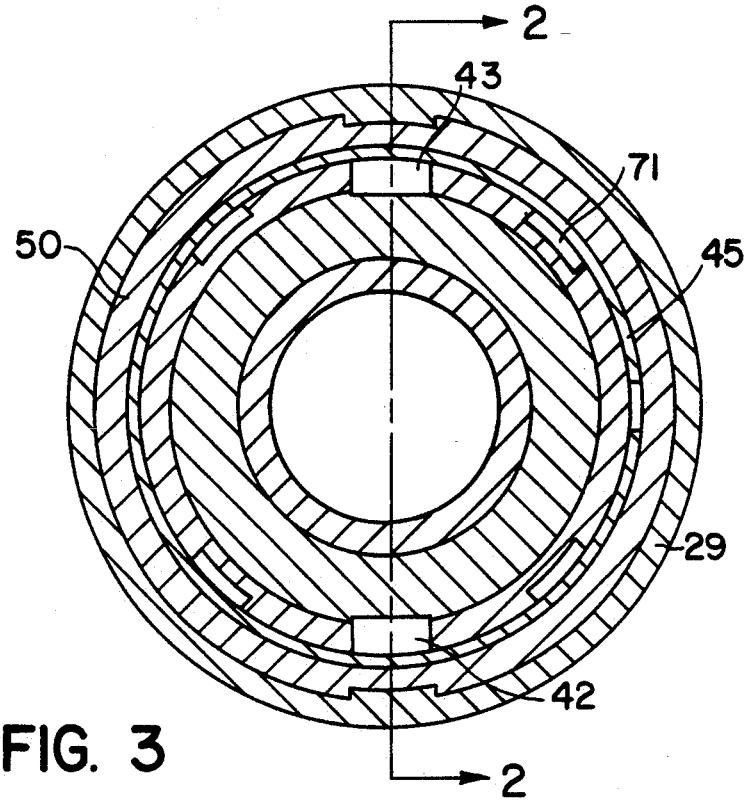
Figure 4:
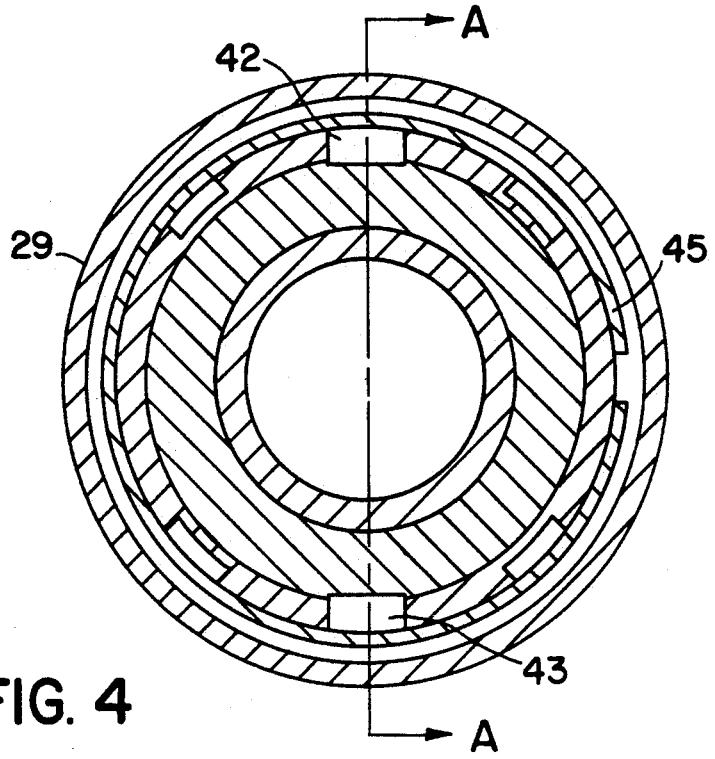

In the drawings, wherein like reference characters are used, throughout to designate like parts:

FIGS. 1A and 1B are vertical sectional views of the upper and lower ends of wellhead equipment constructed in accordance with the preferred embodiment of the present invention, and as seen along broken lines 1—1 of FIG. 3, and showing the tubing hanger lowered on the running tool into landed position within the bore of the casing head, as the seal assembly is supported by the running tool in a raised position with respect to the annulus between the tubing hanger and bore of the casing head so as to permit flow therethrough;

FIGS. 2A and 2B are vertical sectional views of the upper and lower ends of the wellhead equipment, similar to FIGS. 1A and 1B, and as seen along broken lines 2—2 of FIG. 4, but upon lowering of the second tubular member of the running tool to lower the seal assembly into sealing engagement with the hanger and bore of the casing head to close off the annulus between them, and latching the seal assembly to the hanger in its lowered position, whereby the first tubular member may be disconnected from the tubular body and the second tubular member from the seal assembly to permit retrieval of the running tool;

FIG. 3 is a cross-sectional view of the hanger, tubular body and running tool, as seen along lines 3—3 of FIG. 1B; and FIG. 4 is a similar cross-sectional view as seen along broken lines 4—4 of FIG. 2B.

With reference now to the details of the above described drawings, the casing head 20 has a bore 21 therethrough with a seat (not shown) at its lower end onto which the tubing hanger 22 has been lowered into landed position. As shown, a tubing string is suspended from the lower end of a bore 23 through the tubing hanger for extension downwardly within the casing string to which the casing head is connected.

The tubing hanger has been lowered into its landed position by means of a running tool indicated in its entirety by reference character 24, and a seal assembly 25 is supported from the running tool for movement between a raised position, as shown in FIGS. 1A and 1B, in which it opens an annular space between the tubing hanger and bore of the casing head, and a lowered position, as shown in FIGS. 2A and 2B, wherein it sealably engages the outside of the hanger and the bore to close off the annular space. Thus, the hanger has a downwardly and outwardly tapered conical surface 26 thereabout over which a similarly tapered inner surface of the seal assembly is slidable as it moves downwardly into the position of FIG. 2B.

The running tool includes a first tubular member 28 which is connectable to the lower end of a pipe string for lowering therewith, and a second tubular member 29 which is disposed about the upper end of the first tubular member for vertical reciprocation with respect to it. The upper end of the second tubular member has a lug 30 which fits within a vertical slot 31 in the first tubular member forming a spline to prevent relative rotation between the first and second tubular members. In a manner to be described, the seal assembly is releasably connected to the lower end of the second tubular member for raising and lowering therewith.

The lower end of the first tubular member is connected by left-hand threads 34 to a tubular body 32 which in turn is connected to the outer diameter of the tubing hanger by right-hand threads 33. When the tubular body is threadedly connected to the tubing hanger, seal rings 35 carried about its inner diameter sealably engage a seal surface 36 about a cylindrical neck on the upper end of the tubing hanger above threads 33.

As previously described, the first and second tubular members are provided with means which form pressure chambers between them to which pressure fluid may be alternately supplied or exhausted to raise or lower the second member with respect to the first tubular member, and thus raise and lower the seal assembly from and into the annular space between the tubing hanger and bore of the casing head. For this purpose, the first tubular member has a downwardly facing shoulder 37 about a radially enlarged portion thereof above an upwardly facing shoulder 38 at the upper end of a lower radially enlarged portion thereof. The second tubular member has a piston 39 formed about its inner diameter for reciprocation between the shoulders of the first tubular member to divide the annular space into upper and lower pressure chambers 40 and 41, and the piston has seal rings formed thereabout for sealably engaging a reduced diameter portion of the first tubular member between the shoulders, and the enlarged diameter portions of the first tubular member carry seal rings over which the inner diameter of the second tubular member is slidable above and below its piston. Thus, pressure fluid may be introduced from a source at the surface into the upper chamber and exhausted from the lower chamber to lower the piston, and thus the seal assembly. Alternatively, pressure fluid may be introduced into the lower chamber while being exhausted from the upper chamber to raise the second member and thus the seal assembly.

Vertical slots 42 are formed in the outer diameter of the tubular body to receive lugs 43 carried in holes 44 in the first tubular member of the running tool. More particularly, the C-ring 45 fits within a groove about the outer diameters of the lugs as well as a groove about the outer diameter of the outer tubular section of the first tubular member so as to yieldably urge the lugs radially inwardly and thus into the slots in the tubular body, whereby the tubular body is prevented from rotating with the first tubular member of the running tool as they are lowered with the hanger. Consequently, upon landing of the hanger, the running tool may be rotated with the pipe string to the right so as to impart right-hand rotation to the tubing hanger and thus to the tubing string without disconnecting the running tool from the hanger.

The seal assembly is of a construction similar to that shown and described in prior U.S. Pat. No. 4,757,868, assigned to the assignee of the present invention. Thus, it includes an inner wall on which inner surface 27 is formed to slide downwardly and outwardly along the downwardly and outwardly tapered conical surface 26 about the tubing hanger. Also, two sets of legs 46 extend inwardly from the outer side of the wall with each set diverging outwardly toward one another, and seal rings of elastomeric material are received between each set of legs, so that, upon wedging of the seal assembly into the space between the tubing hanger and casing head, the legs and seal assembly form a metal-to-metal as well as elastomeric seals between the outer conically shaped surface of the tubing hanger and the bore of the casing head.

The seal assembly also includes a latch ring 50 connected at 53 to the upper end of its inner wall for limited radial movement with respect thereto and releasably connected to the lower end of the second tubular member by means of a pin 51 and J-slot 52 which also permit limited radial movement between them. As will be described to follow, the latch ring is provided with teeth 54 about its inner diameter for engaging teeth 55 about the tubing hanger above the downwardly and outwardly tapered surface 26 thereabout in order to latch the seal assembly downward in its annulus closing position, as shown in FIG. 2A. As will also be described to follow, at this time, the J-slot connection between the second tubular member may be rotated with the pipe string to release its J-slot connection with the latch ring, thereby permitting the seal assembly to be retrieved with the running tool.

As the seal assembly is moved downwardly, its latch ring is moved downwardly from about the outer diameter of the lugs which hold the second member from rotation with respect to the first member. As previously described, this releases the lugs to be forced radially outwardly, and thus release the running tool from the tubular body, in response to right-hand rotation of the second tubular member with the pipe string, whereby the running tool may be retrieved from the tubing hanger and latched seal assembly. For this purpose, the inner vertical edges of the lugs and the outer vertical edges of the slots in the outer diameter of the tubular body are chamfered to permit the lugs to be moved outwardly in response to right-hand rotation of the second tubular member.

As the seal assembly is lowered into the annular space, the connection of the latch ring to the lower end of the second tubular member as well as to the upper end of the inner wall of the seal assembly permits its teeth 54 to ratchet downwardly over the teeth 55 on the hanger until the lower end of the seal assembly is wedged between the hanger and bore of the casing head. More particularly, the teeth are of right-hand configuation so that the running tool may be rotated to the right to cause the latch ring to be moved further downwardly to tighten its sealing engagement with the tubing hanger and bore of the casing head.

As also previously described, with the latch ring lowered into latching position, the running tool may be lowered and then rotated a short distance to the left to line up the pins with the upwardly opening legs in the J-slots so that the second tubular member may then be raised to pull its lower end from the J-slot and thus disconnect the second member from the latch ring. Then, the running tool may be rotated further to the left in order to release the connection of the first tubular member to the tubular body and permit retrieval of the running tool from the bore of the casing head.

As shown, pressure fluid may be supplied to or exhausted from the chambers above and below the piston on the second tubular member by means of one or more passageways 60 formed within the first tubular body for connection at their upper ends with conduits (not shown) leading to the source of pressure fluid at the well surface and having radial extensions 61 and 62 at their lower ends connecting to the upper and lower chambers 40 and 41.

In accordance with another novel aspect of the present invention, pressure fluid may be supplied through the running tool and the tubular body to various devices in the well bore by means of passageways 63 formed in the first tubular member to connect with conduits 64 at their upper ends leading to the surface and having lateral extensions connecting their lower ends with lateral extensions on the upper ends of passageways 65 formed in the tubular body. As shown, these lateral extensions communicate with one another intermediate O-rings formed about the first tubular member for sealably engaging the inner diameter of the tubular body. The lower ends of passageways 65 connect with conduits 66 leading to passageways 67 formed in the tubing hanger, which in turn connect at their lower ends with conduits leading to devices in the well beneath the hanger.

A split ring 68 is carried about the tubing hanger at the lower end of its tapered surface 26 in position to be wedged outwardly into groove 69 about the bore of the casing head by the lower end of the inner wall of the seal assembly as the seal assembly is lowered into annulus closing position, thereby locking the hanger downwardly within the bore of the casing head, as shown in FIG. 2B.

As previously described, when the running tool is retrieved, the tubular body may be left in place on the upper end of the tubing hanger to protect the seal surface about the neck of the tubing hanger during subsequent well operations. When those operations have been completed, a running tool may be lowered into connection with the threads at the upper end of the tubular body to permit it to be rotated to the left in order to disconnect it from the tubing hanger and thus permit its retrieval.

Slots 70 and 71 are formed in the outer diameter of the tubing hanger as well as the first tubular member, and ports 72 are formed in the second tubular member to provide a flowway for fluid to bypass the seal assembly when the seal assembly is in its raised position.

By way of review, and as shown in FIGS. 1A and 1B, as the tubing hanger and seal assembly are lowered on the running tool into the bore of the casing head, the seal assembly in its raised position. Upon landing of the hanger within the bore, the running tool may be rotated to the right with the pipe string from which it is suspending in order to in turn rotate other tools connected to the tubing string suspended from the tubing hanger. More particularly, due to the connection of the running tool to the hanger through the tubular body to which the first tubular member is connected by the lugs 45, this is accomplished without releasing the running tool from the hanger.

The second tubular member of the running tool may then be lowered to in turn lower the sealing elements on the lower end of the seal assembly into the annular space between the hanger and bore, as shown in FIG. 2B. As previously described, the latch ring is thus lowered beneath the lugs 50 so that they are free to be rotated out of the slots 51 with the first tubular member.

As the seal assembly is so lowered, the latch ring 45 ratchets over threads 72 about the hanger. If tighter sealing engagement of the seal assembly with the hanger and bore is required, the running tool may be rotated to the right so as to in turn rotate the latch ring to the right, through its J-slot connection to the lower end of the second tubular member, and thus cause the threads on the latch to make up with those on the hanger to further lower the seal assembly into tighter sealing engagement within the space.

In order to then release the lower end of the second tubular member from the latch, and thus the seal assembly, the string is rotated a short distance back to the left to permit it to be raised from its J-slot connection to the latch as the second tubular member is raised. Since the lugs are no longer held in the slots in the tubular member, the pipe string may be rotated further to the right to release the first tubular member from the tubular body in order to retrieve the running tool. Then, of course, when it has served its purpose as a thread protector for the neck of the tubing hanger, the tubular body may be removed from the hanger to permit completion of the well.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Wellhead equipment, comprising a casing head having a bore therethrough adapted to be connected to the upper end of an outer casing string, a tubing hanger having a bore therethrough and from which a tubing string may be connected for lowering therewith through the bore of the casing head and into a landed position in the bore of the head to form an annular space between them, a tubular body adapted to be connected to the tubing hanger by right-hand threads, a seal assembly, a running tool including a first tubular member connectable to a pipe string for lowering therewith and connectable to the tubular body by left-hand threads for lowering the tubing hanger into its landed position, a second tubular member rotatable with but vertically reciprocable with respect to the first member, said members having means which form pressure chambers between them, means for supplying pressure fluid to and exhausting pressure from the chambers to raise or lower the second member with respect to the first, means for releasably connecting the seal assembly to the second member, whereby upon landing of the hanger the seal assembly may be lowered therewith into sealing engagement with the hanger and bore of the head to close off the annular space between them, means for latching the seal assembly in its lowered position within the annular space, and means for locking the second member to the body to prevent rotation therebetween when the second member is in a raised position, whereby the pipe string may be rotated to the right so as to impart right-hand rotation to the tubing string, said locking means being releasable when said seal assembly has been lowered with the second member into said space and said first member has been rotated to the right to release it from threaded connection to said tubular body to permit the running tool to be retrieved.

2. Apparatus of the character described in claim 1, wherein the latching means comprises a recess about the hanger, and a split ring carried by the seal assembly for radial movement into the recess as the seal assembly is lowered into sealing position.

3. Apparatus of the character described in claim 2, wherein the split ring has right-hand threads for engaging matching threads in the recess as it moves into the recess, and the second member is releasably connected to the split ring by a pin and J-slot, whereby the split ring may be lowered in response to right-hand rotation of the running tool and the running tool release from the seal assembly for raising therefrom in response to left-hand rotation thereof.

4. Apparatus of the character described in claim 1, wherein the tubing hanger has a neck with an outer seal surface thereabout, and the tubular body has a lower extension disposable over the seal surface when connected to the hanger.

5. Apparatus of the character described in claim 1, including means for transmitting fluid from above to below the hanger, including a first passageway in the first member connectable at one end to the lower end of a conduit extending within the bore of the casing head, and a second passageway in the tubular body connectable at one end to the upper end of a conduit extending downwardly into the annulus and at the opposite end with the opposite end of the first passageway, and means sealing between the tubular body and first tubular member above and below the connection of the opposite ends of the passageways.

6. Apparatus of the character described in claim 1, wherein the locking means comprises a vertical slot in the outer side of the tubular body, a lug carried within a hole in the first tubular member and having an inner end to engage in the slot and an outer end which is held by the seal assembly in the slot when the seal assembly is in raised position, and means about the lug for yieldably holding it in the slot, said lug and slot being so configured as to permit the lug to be moved out of the slot in response to rotation of the running tool to release it from connection to the seal assembly.

* * * * *

UNITED STATES PATENT AND TRADEMARK OFFICE

CERTIFICATE OF CORRECTION

PATENT NO. : 5,244,038

DATED : September 14, 1993

INVENTOR(S) : Bruce J. Watkins

It is certified that error appears in the above-indentified patent and that said Letters Patent is hereby corrected as shown below:

In the drawings, Sheet 1, FIG. 1A, reference numeral " 32 " should be replaced with reference numeral -- 38 --; Sheet 5, FIG. 3, the section line indicated as " 2-2 " should be corrected to read -- 1-1 --; Sheet 5, FIG. 4, the section line indicated as " A-A " should be corrected to read -- 2-2 --.

Signed and Sealed this

Seventh Day of November, 1995

Bruce Lehman

*Attest:*

BRUCE LEHMAN

*Attesting Officer*

*Commissioner of Patents and Trademarks*